United States Patent [19]

Pickett

[11] Patent Number: 4,982,535

[45] Date of Patent: Jan. 8, 1991

[54] BARRIER STRUCTURE

[76] Inventor: William H. Pickett, 4331 Marjoram Ct., Alexandria, Va. 22313

[21] Appl. No.: 335,546

[22] Filed: Apr. 10, 1989

[51] Int. Cl.[5] ..... E04H 17/14

[52] U.S. Cl. ..... 52/71; 52/285; 52/587; 52/593; 256/16; 256/26

[58] Field of Search ..... 256/19, 24, 25, 26, 256/27; 52/593, 227, 285, 286, 71

[56] References Cited

U.S. PATENT DOCUMENTS

| | | | |
|---|---|---|---|
| 1,502,438 | 5/1923 | Price . | |
| 1,557,523 | 10/1925 | Hahn | 52/285 |
| 1,783,383 | 12/1930 | Montrief | 50/285 |
| 2,141,397 | 12/1938 | Locke | 52/285 |
| 3,369,334 | 2/1968 | Berg | 52/227 |
| 3,537,687 | 11/1970 | Adelman | 256/19 |
| 3,732,653 | 5/1973 | Pickett | 256/19 |
| 3,890,751 | 6/1975 | Caputo et al. | 52/166 |
| 3,918,877 | 11/1975 | Pickett | 425/443 |
| 3,965,627 | 6/1976 | Fencl | 52/227 |
| 4,111,401 | 9/1978 | Pickett | 256/13.1 |
| 4,138,947 | 2/1979 | Pickett | 104/1 R |
| 4,214,411 | 7/1980 | Pickett | 52/144 |
| 4,529,174 | 7/1985 | Pickett | 256/27 |
| 4,688,362 | 8/1987 | Pedersen | 52/227 |

FOREIGN PATENT DOCUMENTS

| | | | |
|---|---|---|---|
| 683834 | 6/1966 | Belgium | 52/227 |
| 106399 | 5/1917 | United Kingdom | 52/227 |

*Primary Examiner*—John E. Murtagh

*Attorney, Agent, or Firm*—Fish & Richardson

[57] ABSTRACT

A free standing barrier structure consists of two or more modular panels of height and length significantly greater than thickness, disposed to extend generally along a fence line, and a connector for pivotal joining of adjacent modular panels. Each connector consists of a cylinder element of a first diameter and having an upper surface and a lower surface, and a rod element of a second diameter relatively smaller than the first diameter, the cylinder element and rod element being joined in coaxial arrangement. Each modular panel defines at least one vertical tunnel adjacent each end, each tunnel defining a first portion of size and diameter for receiving the cylinder element snuggly therewithin and further defining a second portion, coaxial with the first portion of diameter for receiving the rod element therewithin, and joiners for connectors in tunnels of adjacent modular panels.

19 Claims, 7 Drawing Sheets

BARRIER STRUCTURE

The invention relates to concrete constructions of discrete modular panels and connectors assembled to form outdoor landscape and noise barriers and the like.

Outdoor constructions of this type may be utilized as a barrier against, e.g. intruding people, animals or reptiles, vehicles, fire, wind and wind blown substances, and light, radio frequency, noise and heat. Objectives to be considered, and ultimately balanced, in selection of such a barrier include cost, ease of construction and flexibility of design, particularly where the barrier is to be constructed over varying or difficult terrain, and durability and low maintenance cost.

Prior barriers proposed to meet these objections are described in my earlier patents, including U.S. Pat. No. 3,732,653 (issued May 15, 1973), U.S Pat. No. 4,111,401 (issued June 19, 1978), U.S. Pat No. 4,138,947 (issued Feb. 13, 1979) and U.S. Pat. No. 4,214,411 (issued July 29, 1980), the disclosures of which are incorporated herein by reference, and as embodied in constructions of Fanwall Sales Corporation of Framingham, Mass.

SUMMARY OF THE INVENTION

According to the invention, a free standing barrier structure comprises two or more modular panels of height and length significantly greater than thickness, disposed to extend generally along a fence line, and a connector assembly for pivotal joining of adjacent modular panels. Each connector comprises a cylinder element of a first diameter and having an upper surface and a lower surface, a rod element of a second diameter relatively smaller than the first diameter, and means for joining cylinder element and rod element in coaxial arrangement. Each modular panel defines at least one vertical tunnel adjacent each end of the modular panel, each tunnel defining a first portion of size and diameter for receiving the cylinder element snugly therewithin and further defining a second portion, coaxial with the first portion, of diameter for receiving the rod element therewithin, and means for joining connectors in tunnels of adjacent modular panels.

Preferred embodiments of the invention may include one or more of the following features. A first modular panel defines a joint profile comprising a concave surface of an arc of predetermined radius and a adjacent second modular panel defines a complimentary intersecting joint profile comprising a convex surface of an arc of the same predetermined radius. Preferably the convex surface has an arc extent of the order of up to at least about 180°, and the first and second adjacent modular panels are adapted for intersection at angles of up to at least 45° to either side of a straight wall line. More preferably the convex surface has an arc extent of the order of up to about 270°, and the first and second adjacent modular panels are adapted for intersection at angles of up to 90° for a square corner. The modular panel defines joining surfaces joining the arc ends and the face surfaces of the panel disposed at about 45° to the panel face surfaces. The arcs are disposed symetrically about a panel center plane, midway between panel face surfaces. The panel defines at least three vertical tunnels, the first tunnel centered at the radius center of the convex arc surface, the second tunnel centered inboard of the center of the first tunnel by a first predetermined distance, and the third tunnel centered a second predetermined distance inboard of the center of the concave arc surface. Preferably the second predetermined distance is generally equal to the first predetermined distance plus one radius length. The first portion of the tunnel defines a load-bearing surface transverse to the axis of the tunnel for engagement by the undersurface of the cylinder with compressional load force, preferably the structure further comprises a washer member disposed in the first portion of the tunnel, the washer defining the load-bearing surface. The upper surface of the cylinder is disposed flush with the upper surface of the modular panel, or the cylinder has a tapered upper portion, and the upper surface and upper portion are disposed to protrude from the upper surface of the modular panel to facilitate alignment. The structure comprises a multi-tier arrangement of modular panels, the connector assembly of a first layer adapted for interengagement with the connector assembly of the vertically next adjacent layer of panels. The modular panels-define horizontal interengaging ribs and grooves for multi-tier alignment.

According to a further aspect of the invention, the structure further comprises a panel element disposed to intersect at the intersection of the two modular panels disposed generally along a fence line, the panel element defining a joint profile comprising a convex surface of an arc of a predetermined radius and the two modular panels defining complimentary adjacent joint profiles, each comprising a concave surface of an arc of the same predetermined radius, the concave surfaces of the modular panels engaging upon the convex surface of the panel element. The panel element may be, e.g., a post, or a modular panel of a second, intersecting barrier construction.

These and other features and advantages will be seen from the following description of a presently preferred embodiment, and from the claims.

PREFERRED EMBODIMENT

We first briefly describe the drawings.

Figure 1:
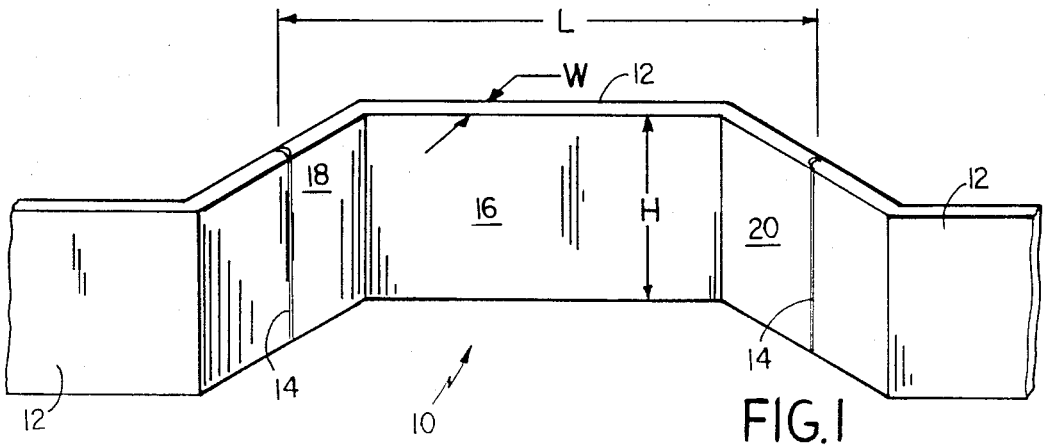
FIG. 1 is a perspective view of one embodiment of an assembled barrier structure of the invention.
Figure 2:
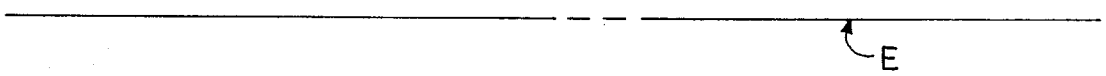
FIG. 2 is a plan view of the barrier of FIG. 1.
Figure 2:
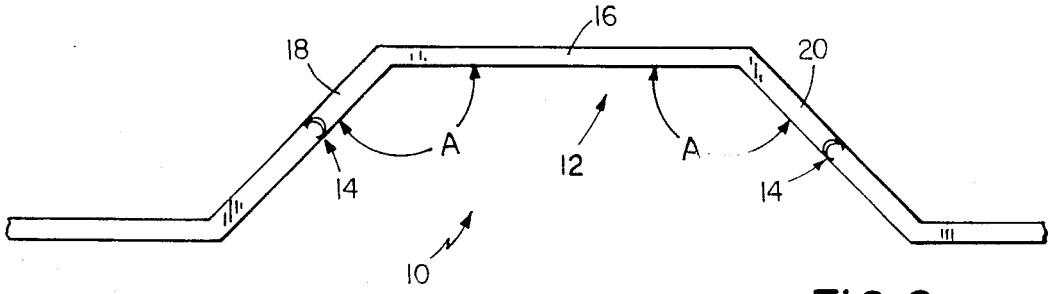
Figure 2D:
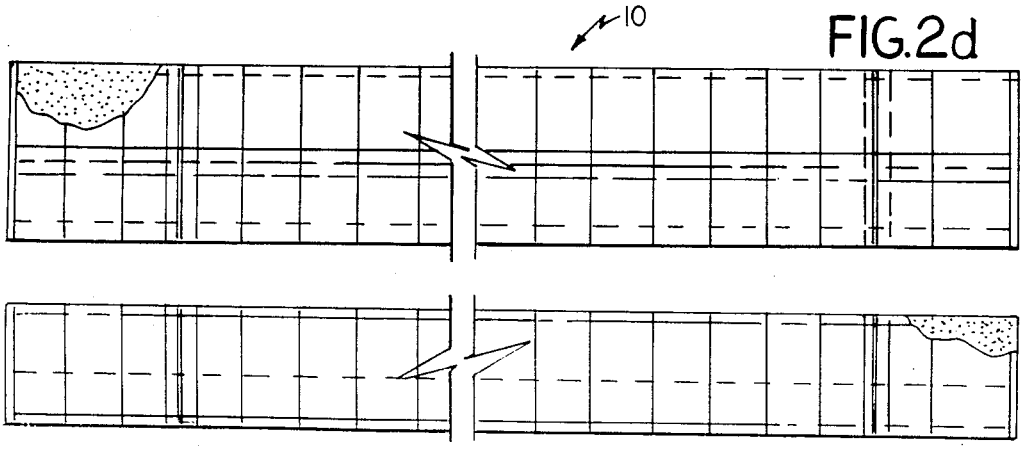
Figure 2A:
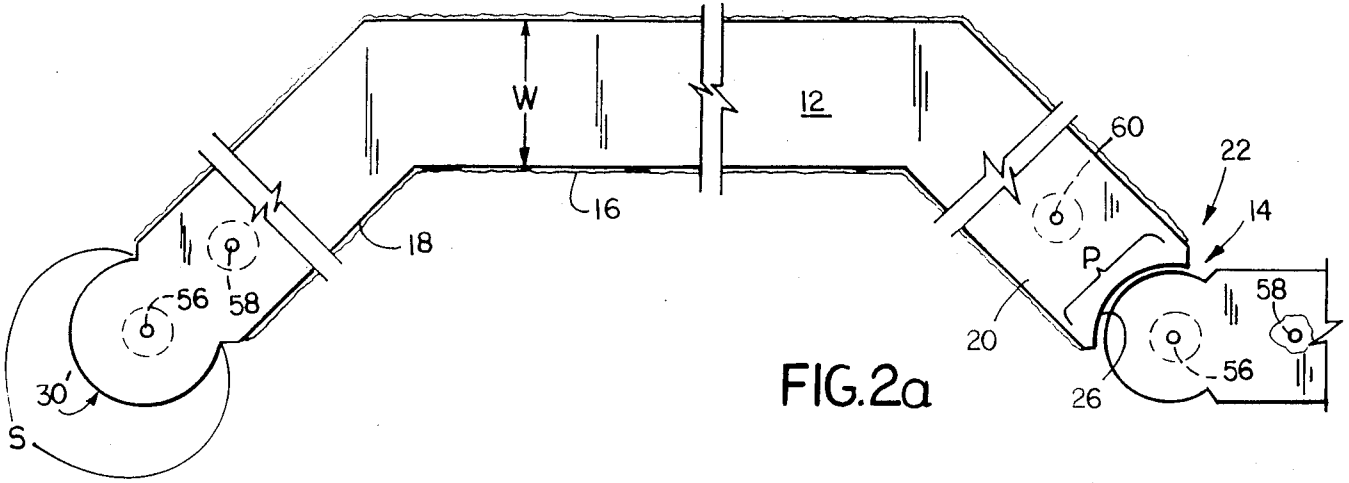
Figure 2C:
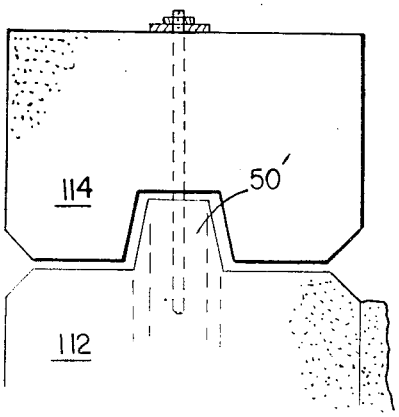
Figure 2B:
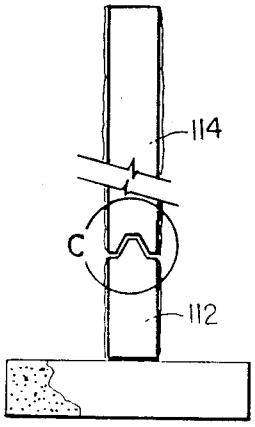

FIG. 2*a* is an enlarged plan view of a vertical modular panel of the barrier of FIG. 1, showing joints with adjacent panels;

FIG. 2*b* is an end section view of a horizontal panel joint, taken at the line 2*b*—2*b* of FIG. 1, while FIG. 2*c* is an enlarged view of the joint taken at the line 2*c*—2*c* of FIG. 2*b;*

Figure 16:
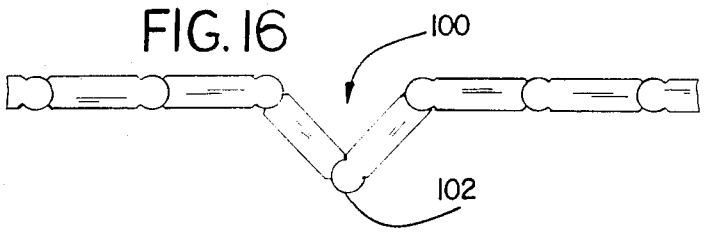
Figure 15:
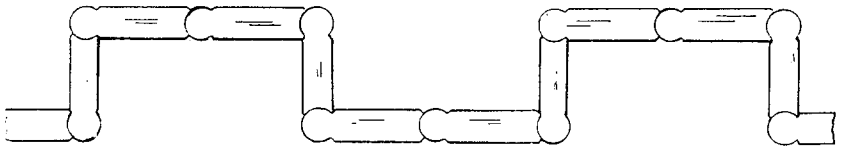
Figure 3:
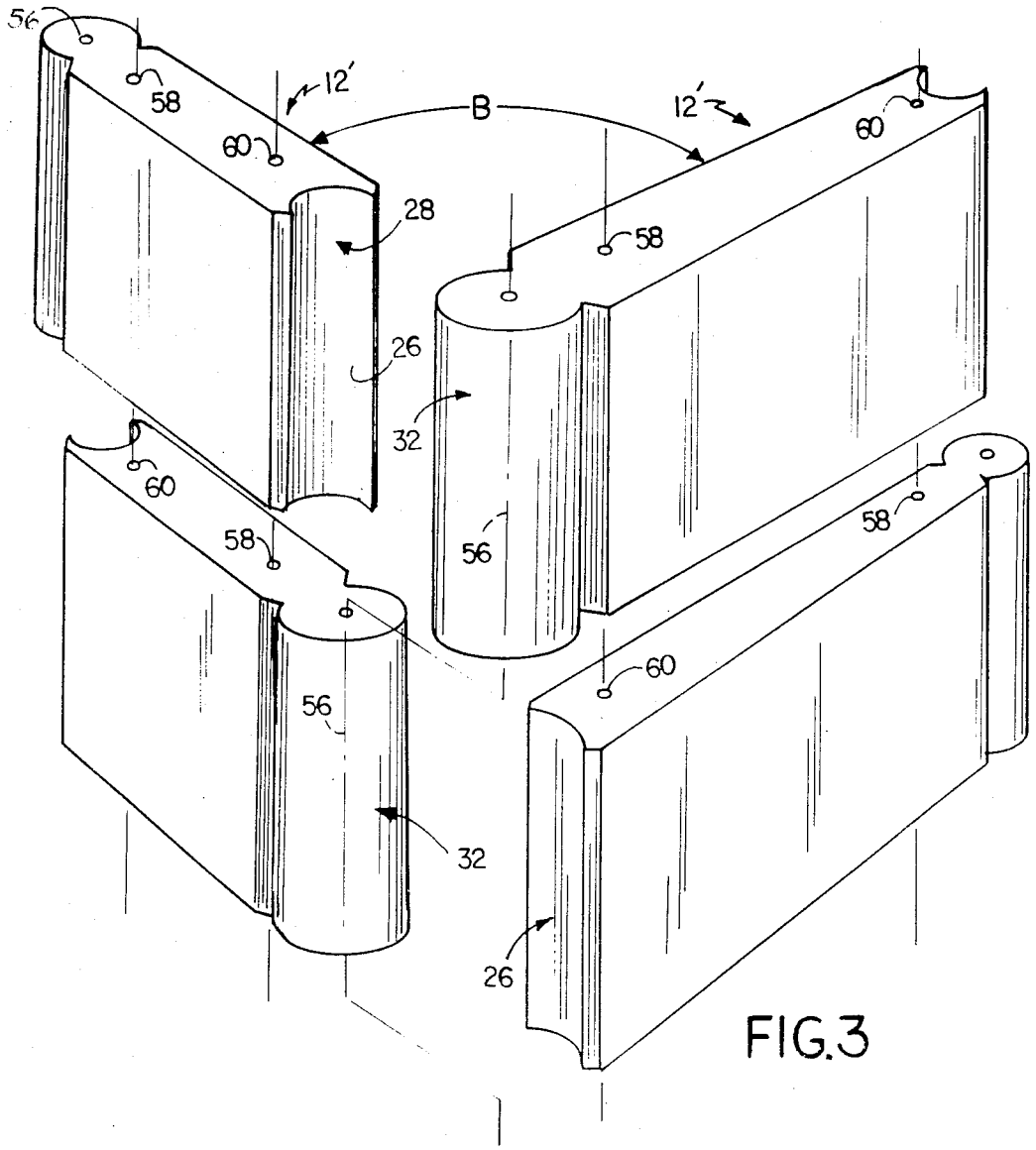
Figure 3A:
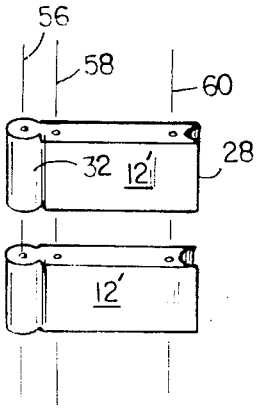
Figure 6:
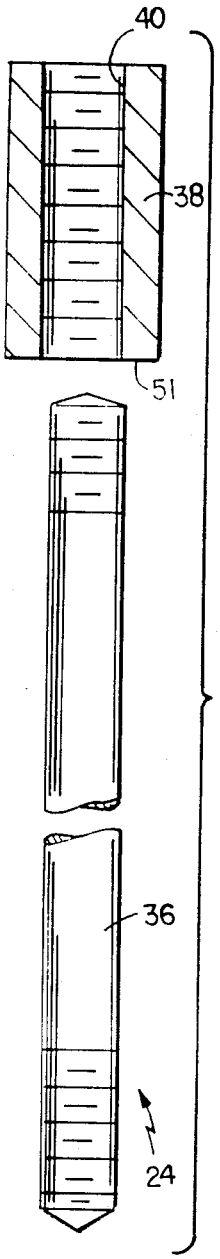
Figure 7:
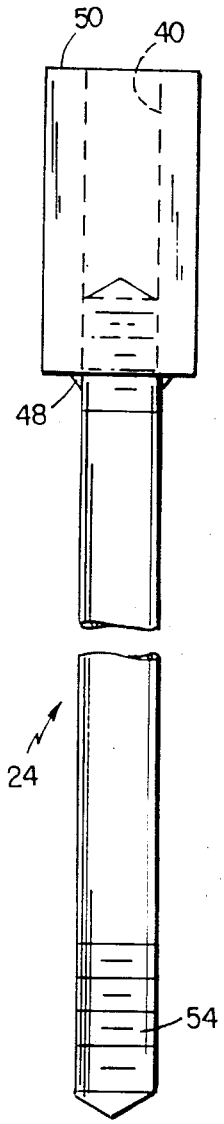
Figure 8:
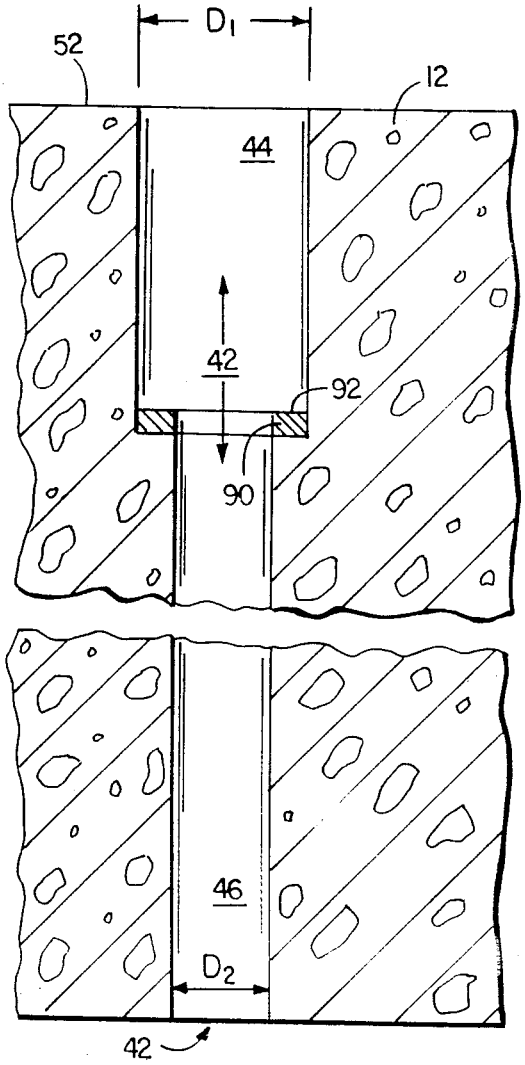
Figure 9A:
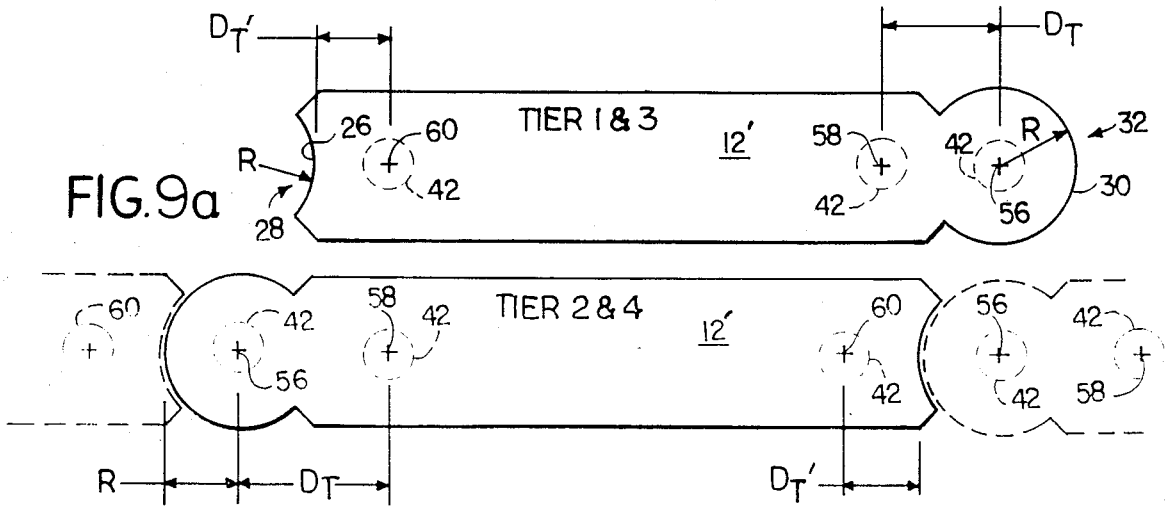
Figure 9:
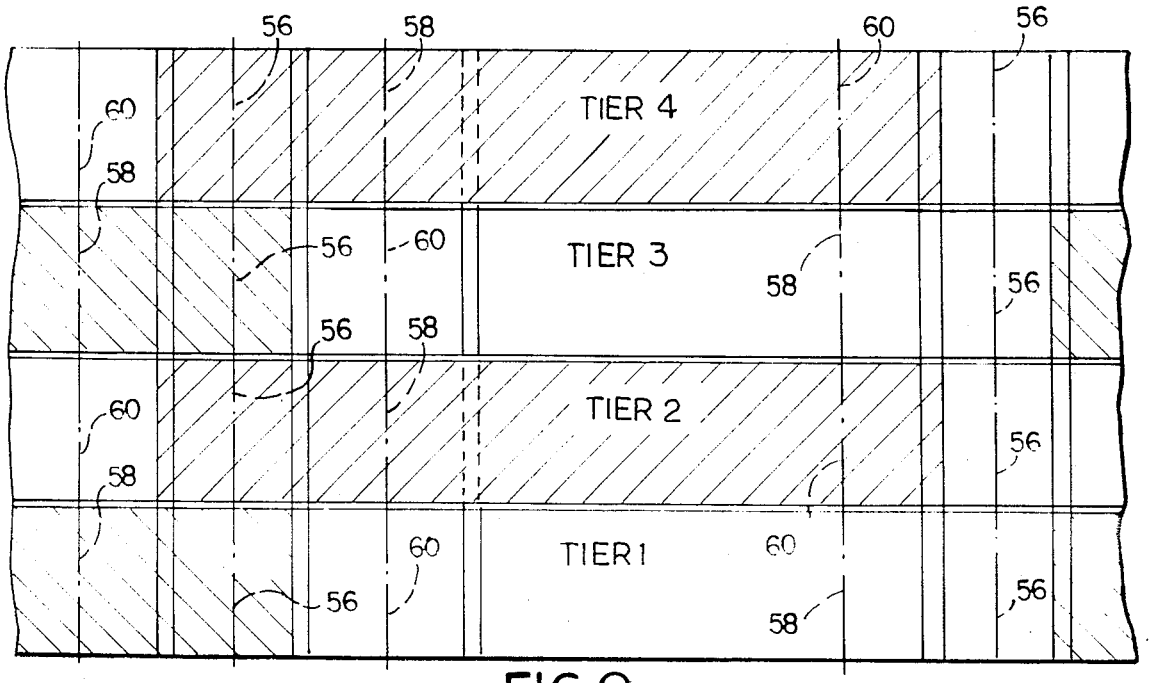
Figure 11:
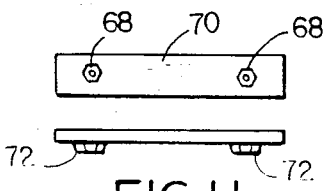
Figure 10:
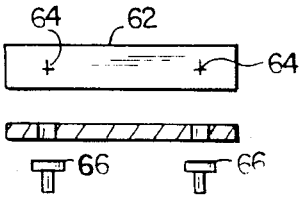
Figure 12A:
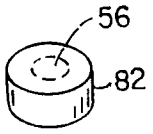
Figure 13:
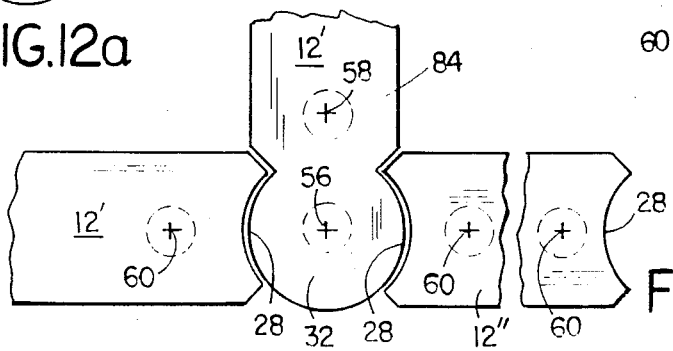
Figure 14:
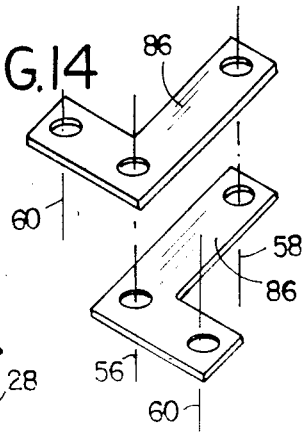
Figure 12:
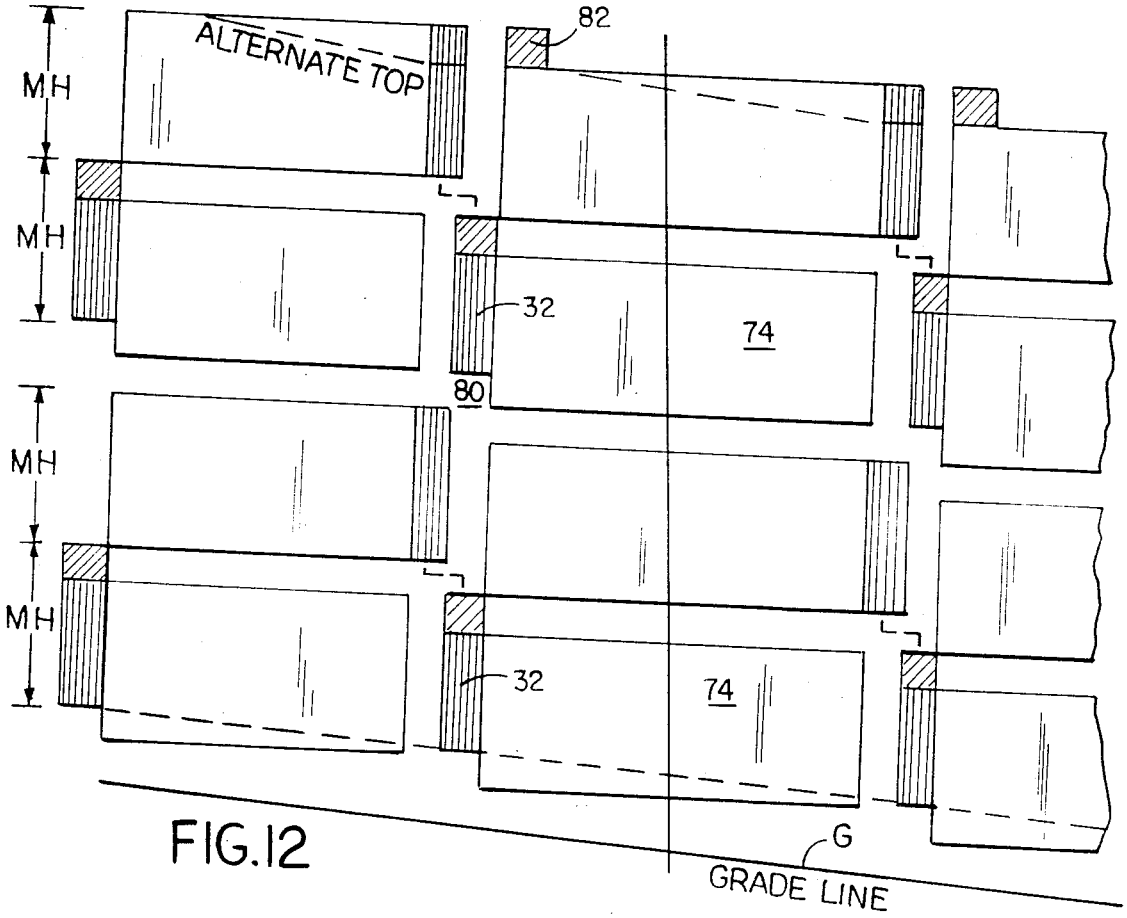

FIG. 2*d* is an exploded face view of the barrier structure of FIG. 1 et seq.;

FIG. 3 is a exploded view in perspective of another two-tier barrier structure showing an alternating arrangement at the joint, while FIG. 3*a* shows an aligned joint;

FIGS. 4 and 4*a* and FIGS. 5 and 5*a* are plan views of two other embodiments of barrier structures and joints of the invention, showing, respectively, straight and angled wall configurations;

FIG. 6 is an exploded plan view of the barrier connector of the invention, while FIG. 7 is an assembly view of the connector;

FIG. 8 is a sectional view of a barrier panel;

FIG. 9 is a somewhat diagrammatic face view of a multi-tier panel barrier construction, while FIGS. 9*a* and 9*b* are somewhat diagrammatic top views showing the intersection of adjacent panels;

FIGS. 10 and 11 are top and side views of the respective top and bottom connector plate assemblies;

FIG. 12 is a somewhat diagrammatic face view of another barrier structure of the invention, while FIG. 12*a* is a perspective view of a puck spacer for use with the barrier of FIG. 12 for sloping gradelines;

FIG. 13 is a somewhat diagrammatic plan view of another embodiment of the invention with a first wall intersected by a second wall or support, while FIG. 14 is an exploded view of a connector plate assembly for use with the barrier of FIG. 13; and FIGS. 15 and 16 are plan views of other barrier constructions.

Referring to FIG. 1 and to FIG. 2 et seq., a barrier wall structure 10 of the invention consists of a series of precast, reinforced concrete modular panels 12 intersecting at joints 14. In the embodiment shown, the panels are free-standing, each having a first portion 16 generally parallel to a general line of extension, E (FIG. 2), and arms 18, 20 disposed at an angle, A, e.g. 45°, to portion 16.

Figure 4:
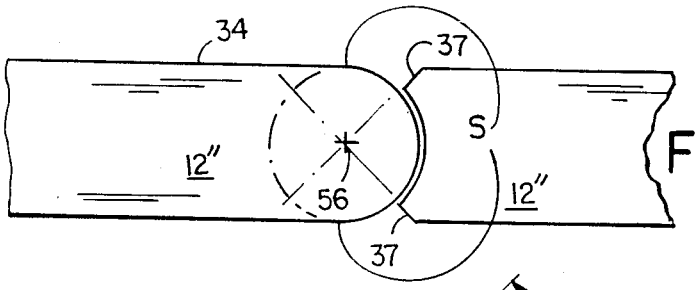
Figure 4A:
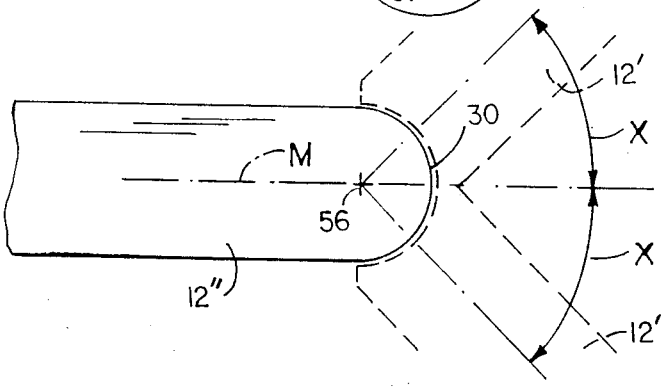
Figure 5:
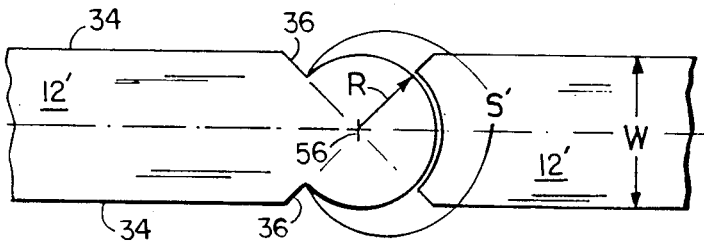
Figure 5A:
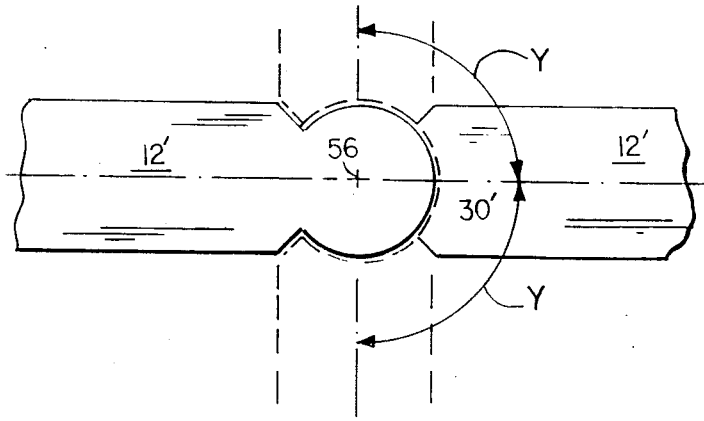

Referring to FIGS. 3, 4 and 5, the panels 12', 12" may also be flat, with the flat panels arranged in a line (FIGS. 3*a*, 4, 5), or may intersect at an angle, B (FIGS. 3, 4*a*, 5*a*), depending, e.g., on terrain, design factors such as wind, or desired appearance.

Each panel 12 has a height, H, length, L, and width, W, each dimension again selected to meet various specifications and requirements of design. One typical panel has dimensions (H×L×W) of 4.00 feet by 24.14 feet by 6.50 inches.

Panel 12 has a rotatable joint profile 22, shown in FIG. 2*a* in plan view, and a compatible pivot connector 24 (FIGS. 7 and 7*a*). The joint profile has a first, concave surface 26 of arc, P, e.g. about 180°, and radius, R (FIG. 9*a*), forming a groove 28, and a second convex mating surface 30 of equal radius, R, forming a tongue 32 on the panel end opposite the groove. The convex surface 30 has an arc, S, e.g. of 90°, for joining adjacent panels at angle, X, up to 45° to either side of a straight wall line, M (FIGS. 4, 4*a*), or, in another embodiment (FIGS. 2*a* and 5, 5*a*), convex surface 30' has an arc S', e.g. of 270°, for joining adjacent panels at an angle Y, e.g , up to 90°, for a square corner. Typically, in the latter embodiment, the radius, R, of the opposed surfaces is one-half the width, W, of the panel, and the arc ends return to the panel face surfaces 34 at a 45° angle, via surfaces 36, as do the arc ends of the concave surface, via surfaces 37. Each of the arcs P, S, and S' are typically disposed symetrically about the panel center plane, midway between the panel face surfaces.

Referring now to FIGS. 6 and 7, the connector 24 consists of a rod 36, externally threaded at both ends, and a elongated cylinder 38 having a central through bore 40 threaded to received the end of the rod in threaded engagement. Referring also to FIG. 8, the panel 12 defines a vertical shaft or tunnel 42 extending through the panel. The tunnel has a first portion 44 of diameter, $D_1$, sized to accommodate the connector cylinder 38, and a second portion 46 of smaller diameter, $D_2$, sized to accomodate the rod. In assembly with the panel 12, the cylinder 38 and rod 36 are fixed against inter-rotation, e g., by weld 48. The upper surface 50 of the cylinder typically lies flush with the top surface 52 of the panel, while the threaded lower end 54 of the rod extends from the panel, e.g. for threaded engagement with the cylinder of a lower-lying panel of a multi-tier wall (as shown in FIG. 9), or with a nut for closure to adjacent panels, as described below with reference to FIG. 11. Disposed within the large bore 44, and the base about the smaller shaft 42 is a metal washer 90 having a flat surface 92 disposed for engagement by the undersurface 51 of cylinder 50 in a manner to accomodate rotational friction and high point loading. As the connector is tightened, the cylinder applies compressional force upon the washer and thus to the panel for securement of the barrier construction.

The tunnels 42 (suggested in dashed line in, e.g., FIGS. 9*a* and 9*b*) are positioned in the panels with a first tunnel centered (56) at the radius center of the convex arc of the tongue 32; the second tunnel is centered (58) inboard of the center 56 of the first tunnel by a distance, $D_T$, typically equal to two radii (R), and the third tunnel is centered (60) a distance $D_T$, typically one radius length, R, inboard of the center of the concave arc surface. In this manner, the panel connectors are hidden from view, and from exposure to the elements or tampering.

A multi-tier barrier is assembled with all of the panels in a single orientation, e.g., each panel having its tongue to the left (FIG. 3*a*), or to the right. Alternatively, as shown in FIGS. 3 and 9, in a first tier, all of the convex edges are arranged with the convex edges pointed in one direction. In the next tier, all of the convex edges point in the opposite direction, and the convex edges overlap such that all tunnels centered at 56 are aligned vertically and tunnels centered at 58 in one tier are aligned with tunnel centered at 60 in the adjacent tier. This creates joints that vertically offset, but that are tied together horizontally by the panels above and below the joint through all angles of rotatability, with the connector 24 through the tunnel centered at 56 serving as the pivot. Vertical tensile stress is taken up by all connectors, and horizontal alignment is established by the offset joint compressively and vertical tensile stress by the connector. A composite construction of those described may also be employed.

Referring to FIG. 10, the top most modular panels are joined horizontally by a flat bar 62 with two holes 64, typically centered one arc radii apart, with bolts 66 threaded into bore 40 of the connector cylinder 38 located in adjacent panels. Referring to FIG. 11, the bottom-most modular panels are joined horizontally in a similar, manner, except that the threaded connector ends pass through the holes 68 in bar 70 into lock nuts 72 welded to bar 70, again typically one radii apart.

In the event of weak soil bearing capacity, or the need for ballasting weight, the lowest wall element may be a grade beam or earth anchor, in which case the modular connector coupling system may be extended to include these elements by threaded engagement of the connector rod therewith.

To compensate for grade changes, it is recommended the horizontal joint be maintained throughout and that a modular height change increment be established. Jagged height changes at vertical joints can be avoided by including sloped or gentle "S" curves to the next height increment and by continuing this height increment as a "non-standard" module. At the bottom of the wall jagged horizontal offsets and greater offsets can be tolerated if buried. Referring now to FIG. 12, provision is made for a sloping grade line, G, consisting of a vertical offset of the uphill convex edges 32 only of the modular panels 74 by means of a height change increment matched to the panel length and grade. The means for adjustment includes a cut-out 80 of the bottom of each uphill convex edge, and the addition of a puck 82 (FIG. 12*a*) of the convex edge diameter and matching tunnel. The puck has a height equal to the offset cut out, and is also useful as block out module in the precasting process. Other embodiments are with the following claims. For example, one or more panels in a barrier may have two convex or two concave joint surfaces, e.g. referring now to FIG. 13, in order to provide an intersecting second wall 84 or support, the tongue 32 of the first panel of the second wall is disposed between the grooves 28 of two adjacent panels in the wall, the second panel 12'' having concave surfaces at both ends. Referring also to FIG. 14, the panels of FIG. 13 are secured by use of plates 86 centered with the panel tunnels as indicated.

If a third shaft is centered (60) more than one radius from the concave edge, the second shaft is centered (58) the same distance from the center of the first shaft (56) plus one radius (R).

Referring to FIGS. 2*b* and 2*c*, the cylinder 50' may protrude from the upper surface of the panel 112 and may be tapered in a manner to provide a guide for placement of the upper panel 114 thereupon, the panels thus having a horizontal tongue-and groove arrangement to facilitate multi-tier constructions.

Also, the connector cylinder and rod may be joined without threaded engagement, e.g. by welding alone.

Other construction arrangements of modular panels will occur to the designer due, e.g., to engineering and/or appearance factors. For example, the panels may be arranged in a square wave pattern with one or more panels per straight line segment (FIG. 15). Also, to accommodate wind load requirements, a sharp zig-zag 100 (FIG. 16) may be introduced in order to provide some support with the zig-zag, thus reducing the load requirement on the post 102.

What is claimed is:

1. A free standing barrier structure comprising two or more modular panels of height and length significantly greater than thickness, disposed to extend generally along a fence line, and a connector assembly for pivotal joining of adjacent modular panels, each said connector assembly comprising a cylinder element of a first diameter and having an upper surface and a lower surface, a rod element of a second diameter relatively smaller than said first diameter, and means for joining said cylinder element and said rod element in coaxial arrangement, each said modular panel defining at least three, horizontally spaced apart, vertical tunnels, at least one said vertical tunnel defined by said modular panel adjacent each end of said modular panel, each said horizontally spaced apart, vertical tunnel defining a first portion of size and a first diameter for receiving the cylinder element snugly therewithin and further defining a second portion, vertically coaxial with said first portion, of a second diameter smaller than said first diameter for receiving said rod element snugly therewithin, and means for joining connectors in horizontally spaced apart vertical tunnels of adjacent modular panels.

2. The free standing barrier structure of claim 1 wherein a first said modular panel defines a joint profile comprising a concave surface of an arc of predetermined radius and an adjacent second said modular panel defines a complimentary intersecting joint profile comprising a convex surface of an arc of the same predetermined radius.

3. The free standing barrier structure of claim 2 wherein said convex surface has an arc extent of the order of up to at least about 180°, and said first and second adjacent modular panels are adapted for intersection at angles of up to at least 45° to either side of a straight wall line.

4. The free standing barrier structure of claim 3 wherein said convex surface has an arc extent of the order of up to about 270°, and said first and second adjacent modular panels are adapted for intersection at angles of up to 90° for a square corner.

5. The free standing barrier structure of claim 1 wherein said modular panel defines joining surfaces joining the arc ends and the face surfaces of the panel, said joining surfaces disposed at about 45° to said panel face surfaces.

6. The free standing barrier structure of claim 1 wherein said arcs are disposed symetrically about a panel center plane, midway between panel face surfaces.

7. The free standing barrier structure of claim 1 wherein a first said tunnel is centered at the radius center of the convex arc surface.

8. The free standing barrier structure of claim 1 wherein a second said tunnel is centered inboard of the center of the first said tunnel by a first predetermined distance.

9. The free standing barrier structure of claim 1 wherein a third said tunnel is centered a second predetermined distance inboard of the center of the concave arc surface.

10. A free standing barrier structure comprising two or more modular panels of height and length significantly greater than thickness, disposed to extend generally along a fence line, and a connector assembly for pivotal joining of adjacent modular panels, each said connector assembly comprising a cylinder element of a first diameter and having an upper surface and a lower surface, a rod element of a second diameter relatively smaller than said first diameter, and means for joining said cylinder element and said rod element in coaxial arrangement.

each said modular panel defining at least three horizontally spaced apart vertical tunnels, at least one said vertical tunnel defined by said modular panel adjacent each end of said modular panel, each said tunnel defining a first portion of said and diameter for receiving the cylinder element snugly therewithin and further defining a second portion, coaxial with said first portion, of diameter for receiving said rod element therewithin, and means for joining connectors in tunnels of adjacent modular panels, a first said tunnel being centered at the radius center of the convex arc surface;

a second said tunnel being centered inboard of the center of the first said tunnel by a first predetermined distance; and a third said tunnel; being centered a second predetermined distance inboard of the center of the concave arc surface;

said second predetermined distance being generally equal to said first predetermined distance plus one radius length.

11. A free standing barrier structure comprising two or more modular panels of height and length significantly greater than thickness, disposed to extend generally along a fence line, and a connector assembly for pivotal joining of adjacent modular panels, each said connector assembly comprising a cylinder element of a first diameter and having an upper surface and a lower surface, a rod element of a second diameter relatively smaller than said first diameter, and means for joining said cylinder element and said rod element in coaxial arrangement, each said modular panel defining at least three, horizontally spaced apart, vertical tunnels, at least one vertical tunnel adjacent each end of said modular panel, each said horizontally spaced apart, vertical tunnel defining a first portion of size and a first diameter for receiving the cylinder element snugly therewithin and further defining a second portion, vertically coaxial with said first portion, of a second diameter smaller than said first diameter for receiving said rod element snugly therewithin, and means for joining connectors in horizontally spaced apart, vertical tunnels or adjacent modular panels, said modular panel in said first portion of said horizontally spaced apart, vertical tunnel defining a load-bearing surface transverse to the vertical axis of said horizontally spaced apart, vertical tunnel for bearing the compressional load force applied by engagement of the undersurface of said cylinder.

12. The free standing barrier structure of claim 11 wherein said structure further comprises a washer member disposed in the first portion of said vertical tunnel, said washer defining a load-bearing surface engaged by the undersurface of said cylinder.

13. The free standing barrier structure of claims 1, 10 or 11 wherein the upper surface of said cylinder is disposed flush with the upper surface of said modular panel.

14. The free standing barrier structure of claims 1, 10 or 11 wherein said cylinder has a tapered upper portion, and said upper surface and said upper portion are disposed to protrude from the upper surface of said modular panel to facilitate alignment.

15. The free standing barrier structure of claims 1, 10 or 11 wherein said structure comprises a multi-tier arrangement of modular panels, the connector assembly of a first layer adapted for interengagement with the connector assembly of the vertically next adjacent layer of panels.

16. The free standing barrier structure of claims 1, 10 or 11 wherein said modular panels define horizontal interengaging ribs and grooves for multi-tier alignment.

17. The free standing barrier structure of claims 1, 10 or 11 comprising a panel element disposed to intersect at the intersection of said two modular panels disposed generally along a fence line, said panel element defining a joint profile comprising a convex surface of an arc of a predetermined radius and said two modular panels defining complimentary adjacent joint profiles, each comprising a concave surface of an arc of the same said predetermined radius, the concave surfaces of said modular panels engaging upon the convex surface of said panel element.

18. The free standing barrier structure of claim 17 wherein said panel element is a post.

19. The free standing barrier structure of claim 17 wherein said panel element is a modular panel of a second, intersecting barrier construction.

* * * * *